US006280540B1

(12) United States Patent
Crook

(10) Patent No.: US 6,280,540 B1
(45) Date of Patent: Aug. 28, 2001

(54) COPPER-CONTAINING NI-CR-MO ALLOYS

(75) Inventor: Paul Crook, Howard County, IN (US)

(73) Assignee: Haynes International, Inc., Kokomo, IN (US)

( * ) Notice: Subject to any disclaimer, the term of this patent is extended or adjusted under 35 U.S.C. 154(b) by 0 days.

(21) Appl. No.: 08/279,289

(22) Filed: Jul. 22, 1994

(51) Int. Cl.[7] ..... C22C 19/05

(52) U.S. Cl. ..... 148/428; 420/443; 420/445; 420/450; 420/454

(58) Field of Search ..... 420/442, 443, 420/445, 450, 453, 454; 148/410, 428; C22C 19/05

(56) References Cited

U.S. PATENT DOCUMENTS

| | | | | |
|---|---|---|---|---|
| 1,836,317 | | 12/1931 | Franks . | |
| 2,777,776 | | 1/1957 | Binder . | |
| 3,203,792 | | 8/1965 | Scheil et al. . | |
| 3,473,922 | * | 10/1969 | Culling | 420/454 |
| 4,080,201 | | 3/1978 | Hodge et al. . | |
| 4,400,211 | * | 8/1983 | Kudo et al. | 420/453 |
| 4,533,414 | | 8/1985 | Asphahani . | |
| 4,692,305 | * | 9/1987 | Rangaswamy et al. | 420/454 |
| 4,906,437 | | 3/1990 | Heubner et al. . | |
| 5,019,184 | * | 5/1991 | Crum et al. | 420/453 |

FOREIGN PATENT DOCUMENTS

| | | | | |
|---|---|---|---|---|
| 92397 | * | 10/1983 | (EP) | 420/453 |
| 366646 | * | 5/1990 | (EP) . | |
| 1.160.836 | | 1/1957 | (GB) . | |
| 57-92151 | * | 6/1982 | (JP) | 420/453 |
| 62-158847 | * | 7/1987 | (JP) . | |
| 62158847 | * | 7/1987 | (JP) . | |
| 62158849 | * | 7/1987 | (JP) . | |
| 05255784 | * | 10/1993 | (JP) . | |
| 5-255784 | * | 10/1993 | (JP) . | |
| 06-017173 | * | 1/1994 | (JP) . | |
| 06248378 | * | 9/1994 | (JP) . | |

OTHER PUBLICATIONS

06–017,173 01/94 JP (VI).*
366,646 05/90 EP(II).*
Heubner et al; "The Corrosion Behavior of Copper–Alloyed Stainless Steels in Reducing Acids" 1985, ATB Metallurgie XXV, No. 3, pp. 235–241.
Leonard; "Development of Corrosion Resistant Alloys by Potentiostatic Methods", Internal Report, Union Carbide Stellite Division, written Dec. 1964.
Leonard; "Development of Corrosion–Resistant Alloys by Potentiostatic Methods Part II", Internal Report, Union Carbide Stellite Division, written Jul. 1965.
Alloy Digest Ni–23, "HASTELLOY Alloy–C", Published by Engineering Alloys Digest, Inc., Feb. 1956.
Alloy Digest Ni–113, "HASTELLOY Alloy–G", Published by Engineering Alloys Digest, Inc., May 1966.
Alloy Digest Ni–164, "HASTELLOY Alloy C–276", Published by Engineering Alloys Digest, Inc., May 1971.
Alloy Digest Ni–211, "HASTELLOY Alloy C–4", Published by Engineering Alloys Digest, Inc., Nov. 1974.
Alloy Digest Ni–317, "HASTELLOY Alloy C–22", Published by Engineering Alloys Digest, Inc., Jul. 1985.

* cited by examiner

*Primary Examiner*—George Wyszomierski
(74) *Attorney, Agent, or Firm*—Buchanan Ingersoll, P.C.

(57) ABSTRACT

The C-type nickel base alloys of the type containing significant amounts of chromium (about 16 to 25%) and molybdenum (about 12 to 18%) may be improved by adding small but critical amounts of copper (about 1 to 3.5%) which their general corrosion resistance to a wide range of both oxidizing and non-oxidizing industrial media.

8 Claims, 2 Drawing Sheets

COPPER-CONTAINING NI-CR-MO ALLOYS

FIELD OF THE INVENTION

This invention relates generally to non-ferrous metal alloy compositions and more specifically to a particular family, called C-types, of nickel base alloys containing significant amounts of chromium and molybdenum along with minor, but important, amounts of other alloying elements which impart general corrosion resistance to the alloys.

BACKGROUND OF THE INVENTION

The forerunner of today's general purpose corrosion resistant Ni—Cr—Mo alloys was developed and patented in the 1930's (U.S. Pat. No. 1,836,317) by Russell Franks, working at the time for a predecessor to the developer of the present invention. The commercial embodiment of this invention was marketed under the name Alloy C and included, besides chromium and molybdenum, smaller amounts of iron, the option of a tungsten addition, and minor additions of manganese, silicon, and vanadium to aid in manufacturing. Alloys within this compositional range were found to exhibit passive behavior in many oxidizing acids by virtue of the chromium addition. Also, they exhibited good resistance to many non-oxidizing acids by virtue of the enhancement of nickel's natural nobility by molybdenum and tungsten additions.

Over the years, several discoveries related to this alloy family or system have been made. First, it was identified that carbon and silicon are quite deleterious to the corrosion resistance of these alloys, because they promote the formation of carbides and intermetallic precipitates (such as mu-phase) at grain boundaries within the microstructure. At high carbon and/or silicon levels, these compounds can form upon cooling after annealing, or during elevated temperature excursions, such as those experienced by weld-heat-affected-zones. Since the formation of these compounds depletes the surrounding regions of chromium, molybdenum (and, if present, tungsten), those regions become much more prone to chemical attack, or become "sensitized". The compounds themselves can also be attacked preferentially. A key patent relating to low carbon and low silicon Ni—Cr—Mo alloys (U.S. Pat. No. 3,203,792) having improved thermal stability was issued in 1965. The commercial embodiment of that patent was developed and marketed as Alloy C-276 by the successor to the Haynes Stellite Company and is still the most widely used alloy of this family.

Even with low carbon and low silicon levels, the Ni—Cr—Mo alloys are metastable, i.e. in combination, the alloying elements exceed their equilibrium solubility limits and eventually cause microstructural changes in the products. Exposure of the alloys to the approximate temperature range of 1200° F. to 1800° F. (or about 650–1000° C.)quickly induces metallurgical changes, in particular the precipitation of intemetallic compounds in the grain boundaries, which weaken the structure. To reduce further the tendency for deleterious compounds to form, a tungsten-free, low iron composition called Alloy C-4 was developed and patented (U.S. Pat. No. 4,080,201) by co-workers of the present inventor. This patent required a carefully controlled composition and also included small but important amounts of titanium to combine with any residual carbon and nitrogen. Similarly, U.S. Pat. No. 5,019,184 again teaches that low iron and low carbon plus some titanium reduces Mu phase formation by enhancing thermal stability in these alloys.

Another important discovery with regard to C-type alloys containing both molybdenum and tungsten was that optimum corrosion and pitting resistance is dependent upon certain important elemental ratios. It was discovered during the development of C-22 Alloy that the Mo:W ratio should lie between about 5:1 and 3:1 and that the ratio of 2×Cr:Mo+(0.5×W) should fall in the range of about 2.1 to 3.7. See U.S. Pat. No. 4,533,414, also assigned to the assignee of the present invention.

More recently, U.S. Pat. No. 4,906,437 disclosed the subtle effects of the deoxidizing elements aluminum, magnesium, and calcium if kept within certain narrow, specified ranges, with regard to hot workability and influence on corrosion performance. The base composition described in U.S. Pat. No. 4,906,437 is quite similar to that discovered in 1964 by R. B. Leonard who, at that time, was researching C-type alloys for the assignee of the present invention. See G. B. Pat. No. 1,160,836. By performing potentiostatic studies on several compositional variants, Leonard identified Ni—23Cr—15Mo as a suitable design base for developing cast Ni—Cr—Mo alloys.

Of course, different families of alloys, containing some of the same elements but in differing proportions, have been developed to have different properties so as to satisfy different needs in the metallurgical arts. One example of such a different type of alloy is Alloy G, developed by the predecessor of the present assignee during the 1950's to resist phosphoric acid. It superficially resembles the C-type alloys except for containing much more iron and less molybdenum along with some cooper. It is more fully disclosed in U.S. Pat. No. 2,777,766.

Published information relating to the nominal compositions and corrosion properties of these prior art C-type alloys is summarized in Tables A and B.

The aforementioned patents are only representative of the many alloying situations reported to date in which many of the same elements are combined to achieve distinctly different functional relationships such that various phases form providing the alloy system with different physical and mechanical characteristics. Nevertheless, despite the large amount of data available concerning these types of nickel-base alloys, it is still not possible for workers in this art to predict with any degree of accuracy or confidence the physical and mechanical properties that will be displayed by certain concentrations of known elements even though such combinations may fall within broad, generalized teachings in the art, particularly when the new combinations may be thermo-mechanically processed somewhat differently from those alloys previously employed in the art.

SUMMARY OF THE INVENTION

The most desirable attribute of the Ni—Cr—Mo alloys from a chemical process industry standpoint is their successful application in a wide range of corrosive environments. However, it is inappropriate to consider the existing alloys as equal entities, since they vary considerably in their resistance to specific media, depending upon the precise chromium, molybdenum, and tungsten levels. High chromium alloys provide enhanced resistance to oxidizing media, such as nitric acid, for example while low chromium alloys perform better in non-oxidizing solutions such as hydrochloric acid.

Accordingly, a principal object of this invention is to provide a new corrosion resistant alloy with as wide an application range as possible, so as to overcome the limitations of the existing Ni—Cr—Mo alloys, by incorporating many of the best uniform corrosion characteristics of each of the previous alloys in a single new product. This enhanced versatility in both oxidizing and non-oxidizing media should also reduce the risks of premature failure in ill-defined process environments, and under the occasional upset or changing conditions, found in the chemical industry.

It has been found that the above object, as well as other advantages which will become apparent, may be achieved by adding small but critical amounts of copper to C-type base alloys so as to provide new and improved products having compositions generally falling within the following preferred ranges, in weight percent:

| | Preferred | Most Preferred |
|---|---|---|
| Chromium: | 22.0 to 24.5 | 22.35 to 23.65 |
| Molybdenum: | 14.0 to 18.0 | 15.35 to 16.65 |
| Copper: | 1.0 to 3.5 | 1.40 to 1.80 |
| Iron: | Up to 5.0 | 0.30 to 1.50 |
| Silicon: | Up to 0.1 | Up to 0.05 |
| Manganese: | Up to 2.0 | 0.10 to 0.30 |
| Magnesium | Up to 0.1 | Up to 0.05 |
| Cobalt: | Up to 2.0 | Up to 1.95 |
| Aluminum: | Up to 0.5 | 0.15 to 0.30 |
| Calcium: | Up to 0.05 | Up to 0.02 |
| Carbon: | Up to 0.015 | Up to 0.007 |
| Nitrogen: | Up to 0.15 | Up to 0.06 |
| Tungsten: | Up to 0.5 | Up to 0.50 |
| Carbide forming elements: | Up to 0.75 | Up to 0.35 (in total) |
| Nickel: | Remainder | |

Subsequent data herein will show that copper, within a narrow critical range, can be added to many existing high chromium Ni—Cr—Mo alloys to enhance their resistance to non-oxidizing media. The benefits in hydrochloric acid were opposed to previous experimental evidence, and the improved effects, as a function of copper content, are quite unexpected and non-linear, that is more copper does not give better properties.

BRIEF DESCRIPTION OF THE DRAWINGS

While this specification concludes with claims particularly pointing out and distinctly claiming the subject matter which is now regarded as the invention, it is believed that several of the features and advantages thereof may be better understood from the following detailed description of a presently preferred embodiment when taken in connection with the accompanying drawings in which:

DETAILED DESCRIPTION OF THE INVENTION

The discovery of the compositional range defined above involved three stages. First, stag with a base composition (Example C-1) somewhat similar to that proposed by R. B. Leonard (Sample A-5), the corrosion resistance effects of copper were determined at several increments by adding up to about 6.0 wt. % Cu to the base. Examples C-2 to C-7 show the compositions and test results. Then, having established that the optimum copper level is about 1.6% +/−0.3% from a versatility standpoint (see FIGS. 1 & 2), the effects of iron, nitrogen, and tungsten (as a partial replacement for molybdenum) were determined. Finally, the useful ranges of chromium, molybdenum, and a variety of minor elements (typically found in wrought, Ni—Cr—Mo alloys) were established.

The investigation of copper as a possible useful addition to this alloy system was initially prompted by its known benefits in other types of alloy systems, such as the Fe—Ni—Cr—Mo and Ni—Fe—Cr—Mo alloy systems, particularly with regard to its frequent improvement to sulfuric acid resistance. The only previous data concerning the effects of copper in high chromium Ni—Cr—Mo alloys (R. B. Leonard, 1965) inferred a slightly negative effect upon resistance to hydrochloric acid, but a positive effect on resistance to moderate concentrations of sulfuric acid. Only one copper level (2.36 wt. %) was studied by R. B. Leonard, however, and at a relatively low chromium content (21.16 wt. %). Also, the work of R. B. Leonard involved only castings, whereas the primary focus of this invention is wrought products, i.e. sheets, plates, bars, wires (for welding), and tubular products, forged and/or rolled from cast ingots.

For each stage of the project, small heats (usually about 20–25 Kg.) of experimental materials were produced by vacuum-induction melting, electroslag remelting, hot forging, homogenizing (e.g. 50 hrs. at 2250° F. or 1240° C.) and hot rolling at about 2240° F. into plates or sheets about 0.125 in. (3 mm) thick for testing. For each alloy, an appropriate solution annealing treatment (e.g 10–20 min. at 2050–2150° F. or 1130–1190° C. followed by water quenching) was determined by furnace trials. As may be deduced from the list of experimental compositions given in Table C, most of these alloys contained small amounts of aluminum (for deoxidation), manganese (to tie up sulfur), carbon, cobalt, and silicon (typical mill impurities). Small amounts of magnesium were also added to the experimental melts for deoxidation purposes but only traces appear in the final products.

Figure 1:
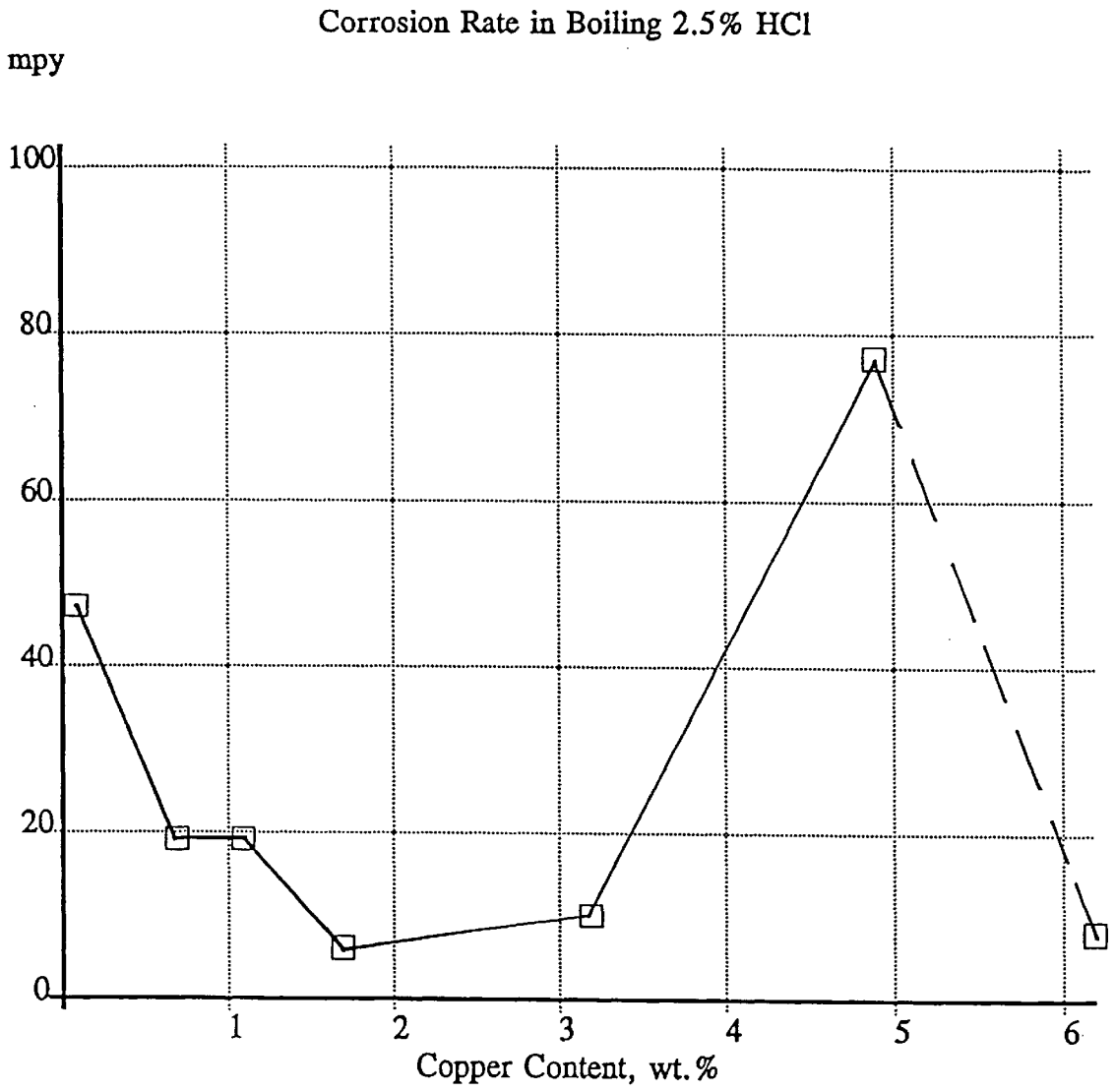
FIG. 1 is a graph illustrating the unexpected relationship between varying copper content in the present alloys and their corrosion rate in boiling 2.5% hydrochloric (HCl) acid.

The effects of copper on the uniform corrosion behavior of high chromium, Ni—Cr—Mo alloys are evident from the test results for the first batch of alloys (Alloys C-1 to C-7 in Table C) and FIG. 1. In both concentrations of sulfuric acid (70% and 90%), copper was found to be extremely beneficial, even at a level of only 0.6 wt. %. In dilute hydrochloric acid, the relationship between copper content and corrosion rate was found to be complex and unexpected. It was discovered that significant benefits accrue from additions of copper in the range 0.6 wt. % to 3.1 wt. %. The corrosion rate at 6.1 wt. % copper was also low, probably because most of the copper partitioned to primary precipitates in the microstructure leaving the matrix with a lower effective concentration. None of the other experimental alloys contained such primary (solidification) precipitates.

Figure 2:
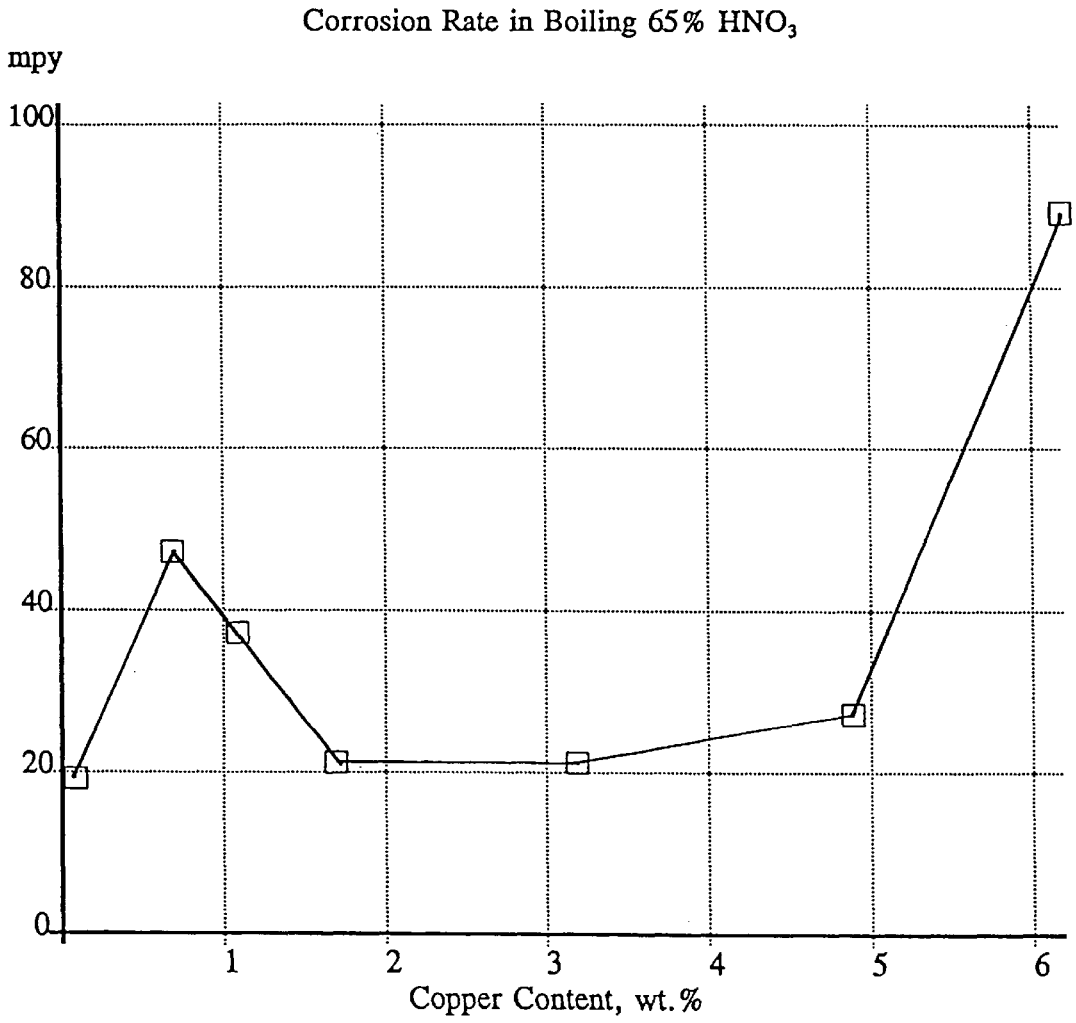
FIG. 2 is a graph showing the unexpected relationship between varying copper content in the preset alloys and their corrosion rate in boiling 65% nitric ($HNO_3$) acid.

With regard to the resistance of the experimental alloys to boiling 65% nitric acid, an unexpected relationship with the copper content was measured. In particular, a peak in the corrosion rate was measured at about 0.6 wt. % copper then lower values until above about 5% as shown in FIG. 2.

Testing of the second batch of alloys (Examples C-8 to C-1 in Table C) revealed that iron, when added in the range 1.0 wt % to 4.2 wt. % has little effect on the general corrosion resistance of the system, at least in alloys with near the optimum copper content (approximately 1.6 wt. %). The partial replacement of molybdenum with about 4.0 wt. % tungsten was found to degrade significantly the resistance to 2.5% hydrochloric acid and 70% sulfuric acid. Nitrogen, at a level of 0.1 wt. % was found to reduce the resistance of the alloy system to 2.5% hydrochloric acid but this disadvantage may be offset by its usually beneficial strengthening effects.

The third batch of alloys (designated Examples C-12 to C-15 in Table C) enabled the preferred boundaries of the alloy system to be better identified. With regard to the minor elements, the effects of these at low levels were studied in Alloy C-12. Their effects at higher levels were studied in Alloy C-13. It was determine that, within the ranges studied, the favorable properties of the system are maintained. The effects of chromium and molybdenum were determined by testing Alloys C-14 and C-15. At low chromium and molybdenum levels (21.6 wt. % and 14.6 wt. % respectively), the resistance of the alloy system to 65% nitric acid was considerably reduced. At high chromium and molybdenum levels (24.2 wt. % and 16.6 wt. %), enhanced uniform corrosion properties were discovered, but the annealed and quenched microstructure exhibited an abundance of grain boundary precipitates, which would be deleterious to the mechanical properties, and promote grain boundary attack in certain media. However, a high chromium content with a low molybdenum content, or a low chromium content with a high molybdenum content would generally be acceptable.

In addition to testing the experimental alloys, certain of the commercial wrought, Ni—Cr—Mo compositions (corresponding to specific patents) were tested also, to allow direct comparisons with the most preferred alloy of this invention (Alloy C-4). Comparative corrosion data are presented in Tables B and C, to further illustrate the advantages or improvements created by this invention.

Several observations may be made concerning the general effects of the various other alloying elements from the foregoing test results (or previous work with similar alloys) as follows:

Aluminum (Al) is an optional alloying element. It is usually used as a deoxidizer during the melting process and is generally present in the resultant alloy in amounts over about 0.1 percent. Aluminum may also be added to the alloy to increase strength but too much will form detrimental $Ni_3Al$ phases. Preferably, up to about 0.50 percent, and more preferably 0.15 to 0.30 percent, of aluminum is present in the alloys of this invention.

Boron (B) is an optional alloying element which may be unintentionally introduced into the alloy during the melting process (e.g., from scrap or flux) or added as a strengthening element. In the preferred alloys, boron may be present up to about 0.05 percent but, more preferably, less than 0.01 percent for better ductility.

Carbon (C) is an undesirable alloying element which is difficult to eliminate completely from these alloys. It is preferably as low as possible since corrosion resistance falls off rapidly with increasing carbon content. It should not exceed about 0.015 percent, but may be tolerated at somewhat higher levels up to 0.05 percent in castngs if less corrosion resistance is acceptable.

Chromium (Cr) is a necessary alloying element in these alloys as explained above. While it may be present from about 16 to 25 percent, the most preferred alloys contain about 22 to 24.5 percent chromium. It seems to form a stable passive film during corrosion of these alloys in oxidizing media. At much higher concentrations, the chromium cannot remain in solution but partitions into second phases which embrittle the alloy.

Cobalt (Co) is almost always present in nickel-base alloys since it is mutually soluble in the nickel matrix. The alloys of the present invention may contain up to about 2 or 3 percent, above which the hot working properties of the alloys may deteriorate.

Copper (Cu) is often an undesirable alloying element in these types of alloys because it generally reduces hot workability. However, as explained above, it is a key component of this invention.

Iron (Fe) is a permissive alloying element. It is commonly present in these types of alloys since the use of ferro-alloys is convenient for adding other necessary allowing elements. However, as the amount of iron increases above about 5%, the corrosion rate increases.

Manganese (Mn) is a preferred alloying element. It is used herein to tie up sulphur and improve hot workability, and is preferably present in alloys of this invention in amounts up to about 2 percent. The most preferred alloys contain at least about 0.1 to 0.3 percent manganese.

Molybdenum (Mo) is a major alloying element of the present invention as explained above. Amounts greater than about 12 percent are necessary to provide the desired corrosion resistance to the nickel base and amounts greater than 14 percent are preferred. However, amounts greater than about 18 percent embrittle the alloys due to the promotion of secondary phases and are difficult to hot work into wrought products.

Nickel (Ni) is the base metal of the present invention and should be present in amounts greater than about 45 percent, in order to provide adequate physical properties and good resistance to stress corrosion cracking to the alloy. However, the exact amount of nickel present in the alloys of the invention is determined by the required minimum or maximum amounts of chromium, molybdenum, copper and other alloying elements present in the alloy.

Nitrogen (N) is an optional strengthening alloying element which may be present up to about 0.015 percent without significant detriment to the general corrosion resistance properties of the alloy even though there is some reduction to resistance to HCl.

Oxygen (O), Phosphorus (P) and Sulphur (S) are all undesirable elements which, however, are usually present in small amounts in all alloys. While such elements may be present in amounts up to about 0.1 percent without substantial harm to alloys of the present invention, they are preferably present only up to about 0.02 percent each.

Silicon (Si) is a undesirable alloying element because it has been shown to to promote the formation of harmful precipitates. While it may be present up to about one percent to promote fluidity during casting into less corrosion-resistant near net shape articles, the preferred alloys contain no more than about 0.1 percent, and, most preferably, less Man about 0.05 percent silicon in wrought products.

Tungsten (W) is an often an optional alloying element which may take the place of some of the molybdenum in these types of alloys. However, because it degrades the corrosion resistance and is a relatively expensive and heavy element, the preferred alloys of this invention contain no more that about one half percent of tungsten.

It is generally known to those skilled in the art that the carbide-forming elements such as titanium, vanadium, niobium, tantalum, and hafnium may be added to the Ni—Cr—Mo alloys (to tie up any carbon) without detriment to the physical properties. Accordingly, it is believed that these elements could be added at levels up to about 0.75 wt. % in total but preferably are only up to 0.35% in this new alloy system.

While in order to comply with the statutes, this present invention has been described in terms more or less specific to one preferred embodiment, it is expected that various alterations, modifications, or permutations thereof will be readily apparent to those skilled in the art. Therefore, it should be understood that the invention is not to be limited to the specific features shown or described, but it is intended that all equivalents be embraced within the spirit and scope of the invention as defined by the appended claims.

TABLE A

| | Prior Art Alloys Nominal Compositions | | | | | | |
|---|---|---|---|---|---|---|---|
| SAMPLE # | A-1 | A-2 | A-3 | A-4 | A-5 | A-6 | A-7 |
| U.S. Pat. No. | 1,836,317 | 3,203,792 | 4,080,201 | 4,533,414 | 4,906,437 | 5,019,184 | 2,777,766 |
| Alloy Name | C | C-276 | C-4 | C-22 | 59 | 686 | G |
| Alloy Digest | Ni-23 | Ni-164 | Ni-211 | Ni-317 | — | — | Ni-113 |
| Nickel | Balance | Balance | Balance | Balance | Balance | Balance | Balance |
| Cobalt | | <2.5 | <2.0 | <2.5 | | | |
| Chromium | 16 | 16 | 16 | 22 | 23 | 20.5 | 22.25 |
| Molybdenum | 16 | 16 | 16 | 13 | 16 | 16.3 | 6.5 |
| Tungsten | 4 | 4 | | 3 | | 3.9 | 0.5 |
| Iron | 5 | 5 | <3 | 3 | 1 | 1 | 19.5 |
| Manganese | <1 | <1 | <1 | <0.5 | | | 1.3 |
| Silicon | <1 | <0.08 | <0.08 | <0.08 | 0.04 | | 0.35 |
| Carbon | <0.08 | <0.01 | <0.01 | <0.01 | 0.005 | 0.006 | 0.03 |
| Aluminum | | | | | | | |
| Vanadium | <0.35 | <0.35 | | <0.35 | | | |
| Titanium | | | <0.7 | | | | |
| Copper | | | | | | | 2.0 |
| Others | | | | | | | 2.12 Cb + Ta |
| Comments | (wrought) | | | | | | |

TABLE B

| | Prior Art Alloys Corrosion Rates - mpy | | | | | | |
|---|---|---|---|---|---|---|---|
| TEST MEDIA | A-1 | A-2 | A-3 | A-4 | A-5 | A-6 | A-7 |
| Alloy Name | C | C-276 | C-4 | C-22 | 59 | 686 | G |
| 2.0% HCl, Boiling | | 51 | 82 | 61 | 5 | 7 | 345 |
| 2.5% HCl, Boiling | | 85 | 44 | 141 | 43 | 17 | 509 |
| 5.0% HCl, Boiling | | 148 | 172 | 327 | 168 | 189 | 858 |
| 10% HCl, Boiling | 329 | | 272 | 444 | 345 | | |
| 65% $HNO_3$, Boiling | | 888 | 217 | 134 | 38 | 230 | 16 |
| 50% $H_2SO_4$, at 93 C. | | 27 | 39 | 31 | 26 | 15 | |
| 70% $H_2SO_4$, at 93 C. | | 24 | 37 | 37 | 38 | 18 | |
| 90% $H_2SO_4$, at 93 C. | | 21 | 104 | 71 | 72 | 8 | |
| 10% $H_2SO_4$, Boiling | | 28 | 17 | 16 | 5 | 3 | 20 |
| 30% $H_2SO_4$, Boiling | | 54 | 73 | 96 | 17 | 12 | |
| 50% $H_2SO_4$, Boiling | | 212 | 392 | 362 | 205 | 180 | 124 |

TABLE C

Experimental Alloys Compositions

| EXAMPLE # | C-1* | C-2 | C-3 | C-4 | C-5 | C-6* | C-7* |
|---|---|---|---|---|---|---|---|
| Heat Number | EN 10289-9-623 | EN 1493-4-672 | EN 1593-4-673 | EN 1092-2-537 | EN 1192-2-538 | EN 1292-2-539 | EN 5292-2-561 |
| Nickel | Balance | Balance | Balance | Balance | Balance | Balance | Balance |
| Cobalt | 0.1 | 0.1 | 0.1 | 0.1 | 0.1 | 0.1 | 0.1 |
| Chromium | 23.0 | 23.1 | 23.1 | 22.8 | 22.8 | 22.8 | 22.9 |
| Molybdenum | 15.8 | 15.5 | 15.5 | 15.8 | 15.7 | 15.7 | 15.6 |
| Tungsten | | | | | | | |
| Iron | 1.1 | 1.2 | 1.0 | 1.0 | 1.0 | 1.0 | 1.0 |
| Manganese | 0.26 | 0.27 | 0.27 | 0.25 | 0.26 | 0.26 | 0.25 |
| Silicon | 0.05 | 0.08 | 0.03 | 0.07 | 0.03 | 0.07 | 0.05 |
| Carbon | 0.006 | 0.006 | 0.007 | 0.006 | 0.004 | 0.004 | 0.004 |
| Aluminum | 0.19 | 0.27 | 0.28 | 0.26 | 0.24 | 0.26 | 0.25 |
| Vanadium | | | | | | | |
| Titanium | | | | | | | |
| Copper | — | 0.6 | 1.0 | 1.6 | 3.1 | 4.8 | 6.1 |
| Other | | | | | | | |
| 2.5% HCl Boiling | 46 | 18 | 18 | 5 | 9 | 77 | 7 |
| 65% $HNO_3$, Boiling | 18 | 44 | 36 | 20 | 19 | 26 | 88 |
| 10% $H_2SO_4$, Boiling | 6 | | | 2 | 2 | 2 | |
| 70% $H_2SO_4$, at 93 C. | 61 | 23 | 21 | 18 | 14 | 14 | 13 |
| 90% $H_2SO_4$, at 93 C. | 92 | 56 | 21 | 13 | 12 | 11 | 10 |

| EXAMPLE # | C-8 | C-9* | C-10* | C-11 | C-12 | C-13 | C-14* | C-15 |
|---|---|---|---|---|---|---|---|---|
| Heat Number | EN 1093-3-658 | EN 1193-3-659 | EN 1293-3-660 | EN 1393-3-661 | EN 0194-4-677 | EN 1893-4-676 | EN 1693-4-674 | EN1793-4-675 |
| Nickel | Balance | Balance | Balance | Balance | Balance | Balance | Balance | Balance |
| Cobalt | 0.1 | 0.1 | 0.1 | 0.1 | — | 0.5 | 0.1 | 0.1 |
| Chromium | 22.8 | 22.8 | 22.9 | 22.5 | 23.3 | 23.2 | 21.6 | 24.2 |
| Molybdenum | 15.9 | 13.0 | 13.1 | 15.9 | 15.9 | 15.7 | 14.6 | 16.6 |
| Tungsten | | 3.9 | 4.1 | | 0.03 | 0.27 | | |
| Iron | 4.1 | 1.0 | 4.2 | 0.9 | 0.05 | 1.3 | 0.9 | 0.9 |
| Manganese | 0.25 | 0.26 | 0.28 | 0.28 | 0.23 | 0.52 | 0.23 | 0.27 |
| Silicon | 0.03 | 0.02 | 0.03 | 0.05 | — | 0.05 | 0.03 | 0.03 |
| Carbon | 0.006 | 0.010 | 0.011 | 0.010 | 0.003 | 0.002 | 0.006 | 0.006 |
| Aluminum | 0.25 | 0.23 | 0.25 | 0.22 | 0.25 | 0.41 | 0.25 | 0.29 |
| Vanadium | | | | | | | | |
| Titanium | | | | | | | | |
| Copper | 1.6 | 1.5 | 1.5 | 1.5 | 1.5 | 1.4 | 1.5 | 1.4 |
| Other | | | | 0.10 Nitrogen | | | | |
| 2.5% HCl, Boiling | 7 | 25 | 18 | 9 | 23 | 19 | 22 | 21 |
| 65% $HNO_3$, Boiling | 20 | 24 | 24 | 23 | 18 | 17 | 94 | 2 |
| 10% $H_2SO_4$, Boiling | | | | | | | | |
| 70% $H_2SO_4$, at 93 C. | 21 | 74 | 55 | 19 | 17 | 18 | 18 | 16 |
| 90% $H_2SO_4$, at 93 C. | 18 | 14 | 17 | 10 | 13 | 16 | 19 | 12 |

*Alloys outside the present Invention.

What is claimed is:

1. A nickel-chromium-molybdenum-copper corrosion resistant alloy consisting essentially of, in weight percent, about:

Chromium: 22.0 to 24.5%;

Molybdenum: 14.0 to 18.0%;

Copper: 1.0 to 3.5%;

Iron: Up to 5.0%;

Silicon: Up to 0.1%;

Manganese: Up to 2.0%;

Magnesium: Up to 0.1%;

Cobalt: Up to 2.0%;

Aluminum: Up to 0.5%;

Calcium: Up to 0.05%;

Carbon: Up to 0.015%;

Nitrogen: Up to 0.15%; and

Tungsten: Up to 0.5%;

with a balance of nickel and inevitable impurities.

2. The alloy of claim 1, wherein effective amounts of at least one of magnesium and calcium are present in a total amount of up to about 0.05% for the purpose of deoxidation.

3. The corrosion resistant nickel-chromium-molybdenum-copper alloy of claim 1 consisting essentially of about:

Chromium: 22.5 to 23.3 wt. %

Molybdenum: 14.6 to 16.6 wt. %

Copper: 1.0 to 3.1 wt. %

Iron: 0.9 to 4.2 wt. %

Silicon: 0.02 to 0.08 wt. %

Manganese: Up to 0.5 wt. %

Cobalt: 0.1 to 0.5 wt. %

Aluminum: 0.19 to 0.41 wt. %

Carbon: Up to 0.01 wt. %

Tungsten: Up to 0.27 wt. % with the balance nickel and inevitable impurities.

4. The corrosion resistant nickel-chromium-molybdenum-copper alloy of claim 1 consisting essentially of about:

Chromium: 23 wt. %

Molybdenum: 16 wt. %

Copper: 1.6 wt. %

Iron: 1.0 wt. %

Silicon: 0.07 wt. %

Manganese: 0.25 wt. %

Cobalt: 0.1 wt. %

Aluminum: 0.26 wt. %

Carbon: 0.006 wt. % with the balance nickel and inevitable impurities.

5. A corrosion resistant nickel-chromium-molybdenum-copper alloy consisting essentially of about:

Chromium: 22.0 to 24.5 wt. %

Molybdenum: 15.0 to 17.0 wt. %

Copper: 1.3 to 1.9 wt. %

Iron: Up to 3.0 wt. %

Silicon: Up to 0.08 wt. %

Manganese: Up to 0.5 wt. %

Cobalt: Up to 2.0 wt. %

Aluminum: Up to 0.5 wt. %

Carbon: Up to 0.01 wt. % with the balance nickel and inevitable impurities and trace amounts of at least one of magnesium and calcium from deoxidation.

6. A process for improving the corrosion resistance of nickel base alloys, having about 22 to 25 wt. percent chromium and 14 to 18 wt. percent molybdenum, and less than about 5% iron, comprising the steps of adding about 1.3 to 1.9 wt. percent copper to the base composition to form an alloy composition consisting essentially of:

Chromium: about 22.5 to 23.3 wt. %

Molybdenum: about 14.6 to 16.6 wt. %

Copper: about 1.0 to 3.1 wt. %

Iron: about 0.9 to 4.2 wt. %

Silicon: about 0.02 to 0.08 wt. %

Manganese: up to 0.5 wt. %

Cobalt: about 0.1 to 0.5 wt. %

Aluminum: about 0.19 to 0.41 wt. %

Carbon: up to b 0.01wt. %

Tungsten: up to 0.27 wt. % with the balance nickel and inevitable impurities; and then forming the resulting alloy into products.

7. A wrought product produced by the process of claim 6, characterized by having a corrosion rate of less than 30 mpy when tested in boiling 2.5% HCl solution.

8. A nickel-chromium-molybdenum-copper corrosion resistant wrought product consisting essentially of, in weight percent, about:

Chromium: 22.35 to 23.65%;

Molybdenum: 15.35 to 16.65%;

Copper: 1.4 to 1.8%;

Iron: 0.3 to 1.5%;

Silicon: Up to 0.05%;

Manganese: 0.10 to 0.30%;

Cobalt: Up to 1.95%;

Aluminum: 0.15 to 0.30%;

Carbon: Up to 0.007%;

Nitrogen: Up to 0.06%;

Tungsten: Up to 0.5%;

Carbide forming elements: Up to 0.35% in total; and with a balance of nickel and inevitable impurities, characterized by having a corrosion rate of less than 30 mpy when tested in boiling 2.5% HCl acid.

* * * * *